United States Patent [19]

Ferguson

[11] 4,131,053

[45] Dec. 26, 1978

[54] ARMOR PLATE

[75] Inventor: Wilfred J. Ferguson, Hillcrest Heights, Md.

[73] Assignee: The United States of America as represented by the Secretary of the Navy, Washington, D.C.

[21] Appl. No.: 484,789

[22] Filed: Aug. 30, 1965

[51] Int. Cl.[2] ..... F41H 5/04

[52] U.S. Cl. ..... 89/36 A; 109/82; 428/469; 428/911

[58] Field of Search ..... 89/36, 36.8, 36 A; 161/213, 225, 404, 183; 29/194, 195, 197, 197.5, 198; 109/80, 82; 23/141; 244/121; 428/469, 972, 911

[56] References Cited

U.S. PATENT DOCUMENTS

| | | | |
|---|---|---|---|
| 3,431,818 | 3/1969 | King | 89/36 A |
| 3,705,558 | 12/1972 | McDougal | 89/36 A |

*Primary Examiner*—Stephen C. Bentley
*Attorney, Agent, or Firm*—R. S. Sciascia; Philip Schneider; Melvin L. Crane

[57] ABSTRACT

This invention is directed to an armor plate made of three layers of different materials each of which are separated by an adhesive. The assembly is an improved assembly which resists penetration from attack by fragments, and projectiles fired from rifles. The first layer is of a hard face material, the second layer has greater ductility than the hard face first phase and the third layer is doron, or any other type of fiberglass laminates.

4 Claims, 2 Drawing Figures

INVENTOR
WILFRED J. FERGUSON

BY Melvin L. Crane AGENT
R. Ciasca ATTORNEY

ARMOR PLATE

BACKGROUND OF THE INVENTION

The present invention relates to armor material and more particularly to armor material for use as both projectile and fragment armor.

Heretofore single and dual component armor have been provided which is suitable for protection against either fragments or projectiles. Thus, different materials are usually used where protection is required for a specific purpose. Other arrangements of materials have been provided wherein one sheet of material is spaced from a primary material for the purpose of tipping or yawing the projectile prior to impact with the armor.

Composite armors utilizing two components with the front surface made from a very hard material have been used in combination with a backing material of doron, a material made of exceedingly tough spun glass fibers woven into fabric and impregnated with a hard plastic, or other types of fiberglass laminates to produce an armor which is the effective armor material known in stopping small caliber (0.30 inch and 0.50 inch) armor piercing projectiles under single hit attack conditions. These materials are not the most effective in stopping fragments.

The present invention overcomes the disadvantages of the prior art armor and provides a combination of materials for breaking an armor piercing projectile into fragments, with a material that stops these and fragments from other sources.

It is therefore an object of the present invention to provide an improved armor combination.

Another object is to provide a superior armor material suitable for stopping both projectiles and for fragments.

Still another object is to provide an armor which is relatively light weight and yet effective for stopping projectiles and/or fragments.

Yet another object is to provide an armor which is effective for a plurality of hits over a relatively small area.

Another object is to provide armor material which is sensitive to obliquity (angle between the armor surface and projectile trajectory).

Figure 1:
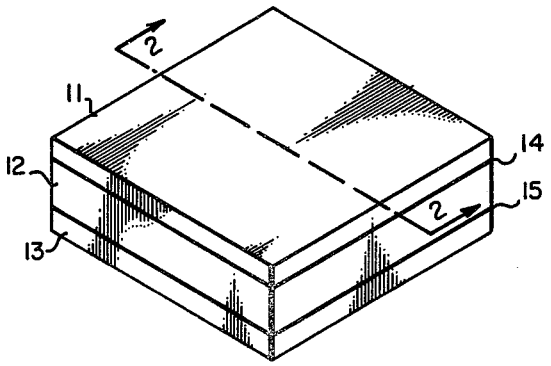
Figure 2:
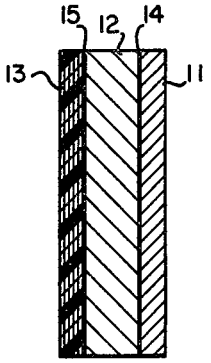

The nature of this invention as well as other objects and advantages thereof will be readily apparent from consideration of the following specification relating to the annexed drawings, in which:

FIG. 1 is a front view partly cut away to illustrate the separate layers of material, and FIG. 2 is a cross sectional view illustrating the relationship of the separate layers of material.

The armor of the present invention is for the purpose of providing a significant improvement in penetration resistance over other armor materials from attack by fragments and by projectiles fired from rifles and/or machine guns. It is well known in the art that composite two phase armor is suitable as protection against either projectiles or fragments, but a single composite armor is not superior to all other armors for both types of attack. In the three or more phase armor of the present invention, the thickness of the hard face first phase may be reduced below that required for two phase armor and afford protection against both projectiles and fragments provided the two adjacent components of the exterior side (attack side) of the armor has a relatively low density and high young's modulus. The second phase should also be made from a material which has greater ductility than the hard face first phase. The composite first and second layer provides at least three purposes in resisting penetration.

These purposes are: (a) to blunt the ogival point of the AP projectiles by use of the hard face first layer, (b) to produce fracturing of the AP projectiles by reflected waves which travel rapidly through both the first and second layers and are reflected at the interface between the second and third layers, the results being the creation of tensile stresses in the projectile sufficient to cause break up of the projectile, (c) the second and third layers are both materials capable of absorbing large amounts of energy and this capability of the third layer is enhanced by the use of high modulus facing materials (layers 1 and 2) which result in loading over larger areas of the third phase than would otherwise be possible. Also, the use of low density materials for the first and second phases results in a longer period of time during which loading can be transmitted to the backing material.

Now referring to the drawing, there is shown by illustration an armor made according to the present invention wherein the same reference characters refer to like parts throughout the drawing. As shown, the armor is formed of three layers 11, 12 and 13 separated only by bonding materials 14 and 15. As an example layer 11 is formed of alumina (aluminum oxide) $A1_2O_3$ of from about 95% to about 99%, having an areal density of from about 2.00 lbs./ft.$^2$ to about 4.00 lbs./ft.$^2$. The second layer, 12, is formed of hot pressed or rolled beryllium which has an areal density of from about 2.00 lbs./ft.$^2$ to about 4.00 lbs./ft.$^2$ and bonded to the alumina by any suitable bonding substance 14 such as rubbery type low modulus resin. The third layer is formed of a resin reinforced with high strength fibers. One material which has been used effectively is doron (fiberglass fabric bonded with polyester resin). The doron is bonded to the beryllium by any suitable bonding material 15 which may be the same as the bonding material between layers 11 and 12.

The armor above has been described as an example of and construction of a three layer armor. Other materials may be used such as silicon carbide, boron carbide, steel, alumina, cermaics in general, titanum, beryllum, an alloy of magnesium, lithuim and aluminum as the first and second layers and high strength nylon fiber laminates, glass fabric and/or fiber laminates and other high strength fiber laminates may be used as the last or backing layer. Also, the composite may be made with more than three layers. Thickness of the layers depend on the specific gravity, Young's modulus density, etc. The important element in making suitable armor is to choose a material for the first layer that in conjunction with the second will breakup a projectile to be protected from and to provide subsequent layers of material that will stop fragments. Thus, providing an armor effective in stopping both AP projectiles and fragments.

Armor formed in accordance with the present invention may be used as protection of personnel in aircraft, automotive vehicles, worn by individuals for protection against bodily harm and many other uses.

Obviously many modifications and variations of the present invention are possible in the light of the above teachings. It is therefore to be understood that within the scope of the appended claims the invention may be practiced otherwise than as specifically described.

What is Claimed and desired to be secured by Letters Patent of the United States is:

1. An armor capable of fragmenting projectiles and protecting against fragments which comprises:

first, second and third layers of different armor material secured together by a bonding material, said first layer is formed of a hard face, low density material, said second layer is formed of a material having a low density and high young's modulus with a greater ductility than said hard face first layer with a thickness greater than said first and said third layer, and said third layer is formed of a resin reinforced with high strength fibers.

2. An armor capable of fragmenting projectiles and protecting against fragments as claimed in claim 1 wherein:

said first layer is selected from a group consisting of aluminum oxide, silicon carbide, boron carbide or other very hard high modulus materials, said second layer is formed from beryllium, or other high modulus materials of lower hardness than the first layer and which have the capability of absorbing large amounts of energy in dynamic loading, said third layer is formed of laminates produced from resins reinforced by high strength fibers.

3. An armor capable of fragmenting projectiles and protecting against fragments as claimed in claim 2 wherein:

said first layer is formed of aluminum oxide, said second layer is formed of beryllium, and said third layer is formed of doron.

4. An armor as claimed in claim 2, wherein, said first layer of armor material has an areal density of from about 2.00 lbs./ft.$^2$ to about 4.00 lbs./ft.$^2$, and said second layer of armor material has an areal density of from about 2.00 lbs./ft.$^2$ to about 4.00 lbs./ft.$^2$.

* * * * *